US005200741A

United States Patent [19]

Usui

[11] Patent Number: 5,200,741

[45] Date of Patent: Apr. 6, 1993

[54] LIQUID-CRYSTAL DISPLAY APPARATUS

[75] Inventor: Minoru Usui, Tokyo, Japan

[73] Assignee: Casio Computer Co., Ltd., Tokyo, Japan

[21] Appl. No.: 441,879

[22] Filed: Nov. 27, 1989

[30] Foreign Application Priority Data

Nov. 30, 1988 [JP] Japan ..... 63-154799[U]

[51] Int. Cl.[5] ..... G09G 3/36

[52] U.S. Cl. ..... 340/784; 340/805; 359/54

[58] Field of Search ..... 340/784, 805, 765, 805; 350/332, 333; 368/84, 242; 358/241, 236; 359/54

[56] References Cited

U.S. PATENT DOCUMENTS

| | | | |
|---|---|---|---|
| 3,950,936 | 4/1976 | Oguey et al. | 368/84 |
| 4,447,131 | 5/1984 | Soma | 350/333 |
| 4,748,444 | 5/1988 | Arai | 340/784 |
| 4,872,059 | 10/1989 | Shinabe | 358/241 |
| 4,901,066 | 2/1990 | Kobayashi et al. | 340/805 |
| 4,932,759 | 6/1990 | Toyano et al. | 340/784 |

FOREIGN PATENT DOCUMENTS 52-36372 9/1977 Japan .

*Primary Examiner*—Ulysses Weldon

*Assistant Examiner*—Doon Yue Chow

*Attorney, Agent, or Firm*—Frishauf, Holtz, Goodman & Woodward

[57] ABSTRACT

A liquid-crystal display apparatus having scanning electrodes and signal electrodes, both being disposed in a matrix arrangement, which divides a selection period for a scanning electrode by m and performs a display based on same data for m times, and which makes different a wave level of a scanning-electrode driving signal during each divided selection period. A liquid-crystal panel driving circuit for driving a liquid crystal panel having scanning-electrodes and signal electrodes, both being disposed in a matrix arrangement, which divides a selection period for a scanning electrode by m and performs a display based on same data for m times, and which makes different a wave level of a signal-electrode driving signal during each divided selection period. A liquid-crystal panel driving circuit for driving a liquid crystal panel having scanning electrodes and signal electrodes, both being disposed in a matrix arrangement, which divides a selection period for a scanning electrode by m and performs a display based on same data for m times, and which makes different respective wave levels of a signal-electrode driving signal and a scanning-electrode driving signal during each divided selection period.

35 Claims, 10 Drawing Sheets

ϕF

V0
<Xn>V2

V4
V1
<Ym>V2
V3

|V0 + V1|
|V0 - V1|
|V1|
<Xn-Ym>0
-|V1|
-|V0 - V1|
-|V0 + V1|

φF

φS
V01
V02

<Xn>V2
V42
V41

V1
<Ym>V2
V3
|V01+V1|
|V02+V1|
|V01-V1|
|V02-V1|

|V1|
<Xn-Ym>0
-|V1|
-|V02-V1|
-|V01-V1|
-|V02+V1|
-|V01+V1|

FIG.5A
FIG.5B
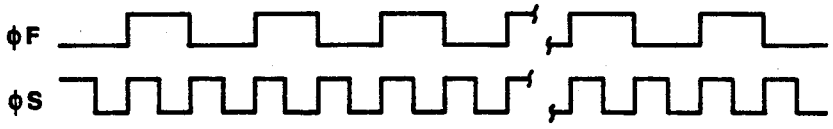
FIG.5C
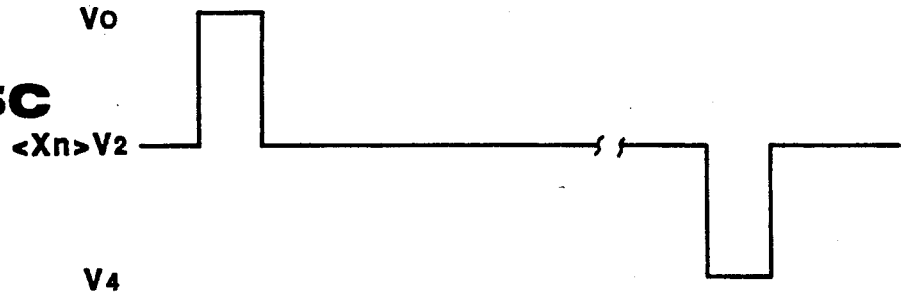
FIG.5D
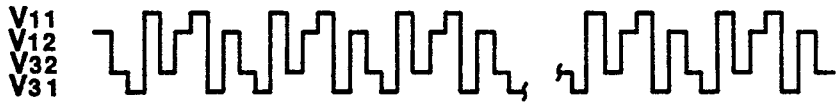
FIG.5E
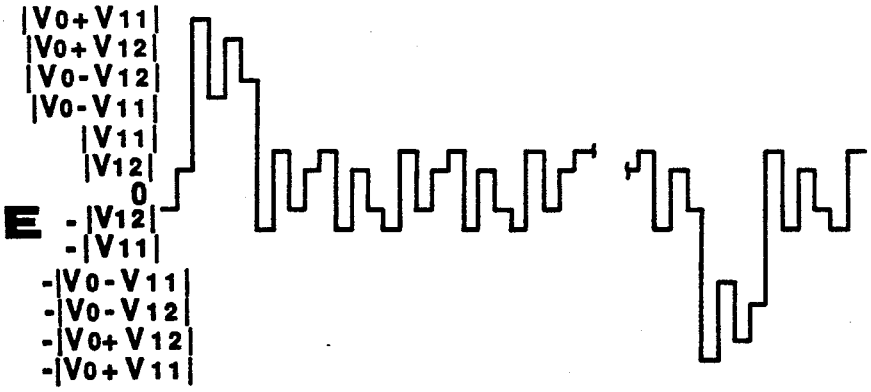

FIG. 9A $\phi F$
FIG. 9B $\phi S$
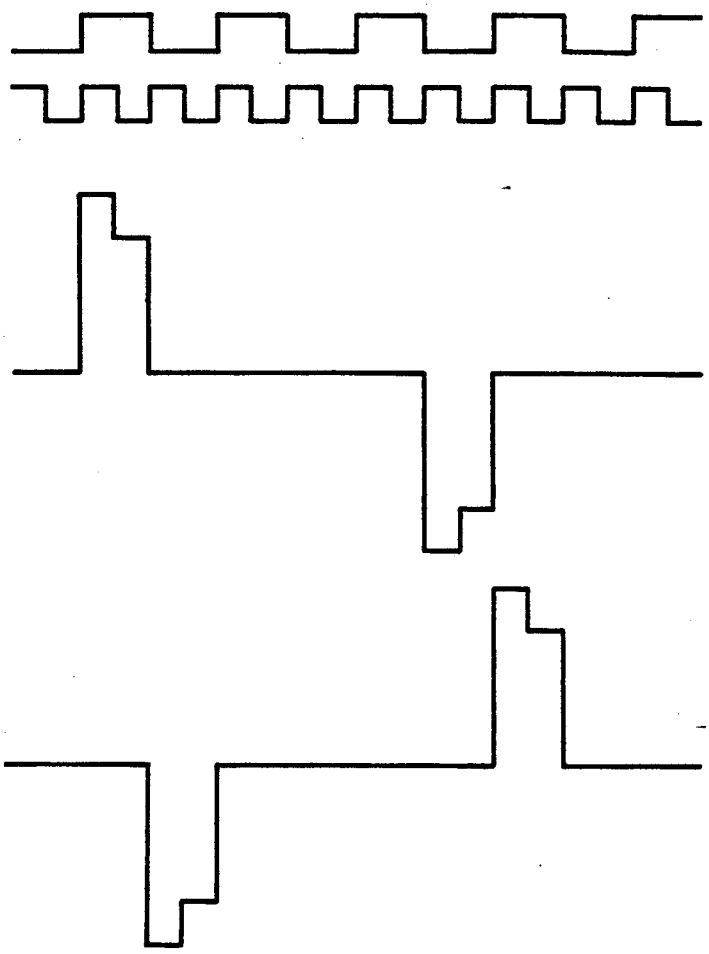
FIG. 9C $X_1$
FIG. 9D $X_2$
FIG. 9E $Y_1$
FIG. 9F $Y_2$
FIG. 9G $Y_3$
FIG. 9H $Y_4$ FIG. 10A $\phi F$
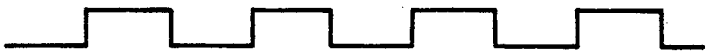
FIG. 10B $X_1$
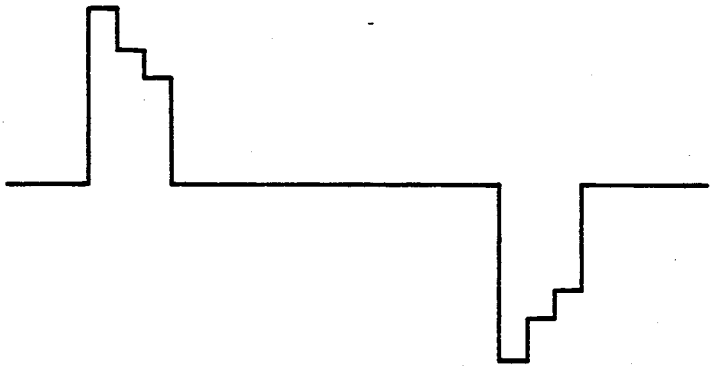
FIG. 10C $Y_1$
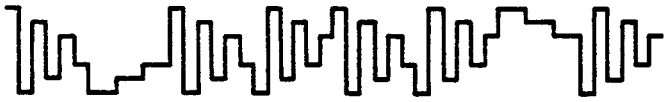
FIG. 10D $Y_2$
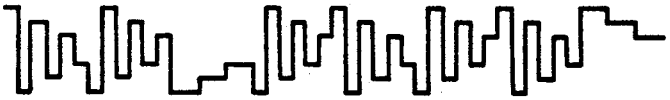
FIG. 10E $Y_3$
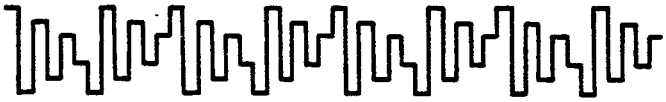
FIG. 10F $Y_4$
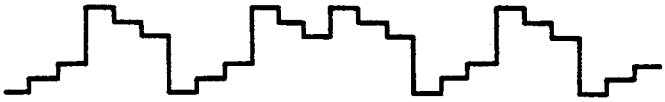

LIQUID-CRYSTAL DISPLAY APPARATUS

BACKGROUND OF THE INVENTION

In general, a liquid-crystal display element has a drawback that the response speed is relatively low. Therefore, there have been made various improvements in methods of driving the liquid-crystal display element and also there have been developments of liquid-crystal materials and liquid-crystal cells for increasing the response speed. In a conventional liquid-crystal display-panel driving circuit for driving a liquid-crystal display panel which has scanning electrodes and signal electrodes disposed in a matrix arrangement, a scanning-electrode driving signal Xn and a signal-electrode driving signal Ym having waveforms shown in FIGS. 1-A to 1-D are used to drive the liquid-crystal display-panel. The scanning-electrode driving signal Xn is composed of pulse signals having a bias voltage V0 or V4, which are developed in response to a frame signal $\phi$F and are sequentially applied to the scanning electrodes. The signal-electrode driving signal Ym is composed of pulse signals having a bias voltage V1 or V3, which are selectively applied to the signal electrodes in response to a video signal. As a result, a composite signal "Xn-Ym" shown in FIG. 1D is applied between the scanning electrodes and the signal electrodes, and the signal electrodes corresponding to the scanning electrodes selected by the scanning-electrode driving signal are driven.

The liquid-crystal display panel is driven in the above described manner, however the above method of driving the liquid crystal display panel still has a problem that the response speed of the liquid crystal has not been sufficiently improved.

SUMMARY OF THE INVENTION

The present invention has been made in the light of the above affairs, and its object is to provide a liquid-crystal display which is capable of increasing the response speed of liquid crystal.

As described above, one or both of the scanning-electrode driving signal and the signal-electrode driving signal during the respective divided periods have different wave levels, so that the peak voltage during the scanning electrode period becomes higher than conventional voltage level and thereby the response speed of the liquid crystal increases.

BRIEF DESCRIPTION OF THE DRAWINGS

FIGS. 2 to 7 are views illustrating embodiments of the present invention;

FIG. 2 is a block diagram illustrating a construction of the first embodiment of the present invention;

FIG. 4 is a block diagram illustrating a construction of the second embodiment of the present invention;

FIGS. 5A, 5B, 5C, 5D and 5E, each, are a timing chart illustrating the operation of the second embodiment;

FIG. 6 is a block diagram illustrating a construction of the third embodiment of the present invention;

FIGS. 9A, 9B, 9C, 9D, 9E, 9F, 9G and 9H, and FIGS. 10A, 10B, 10C, 10D, 10E and 10F, each, are a view illustrating an example of a waveform of a driving signal employed in the third embodiment.

DETAILED DESCRIPTION OF THE PREFERRED EMBODIMENT

Figures 1A, 1B, 1C, 1D:
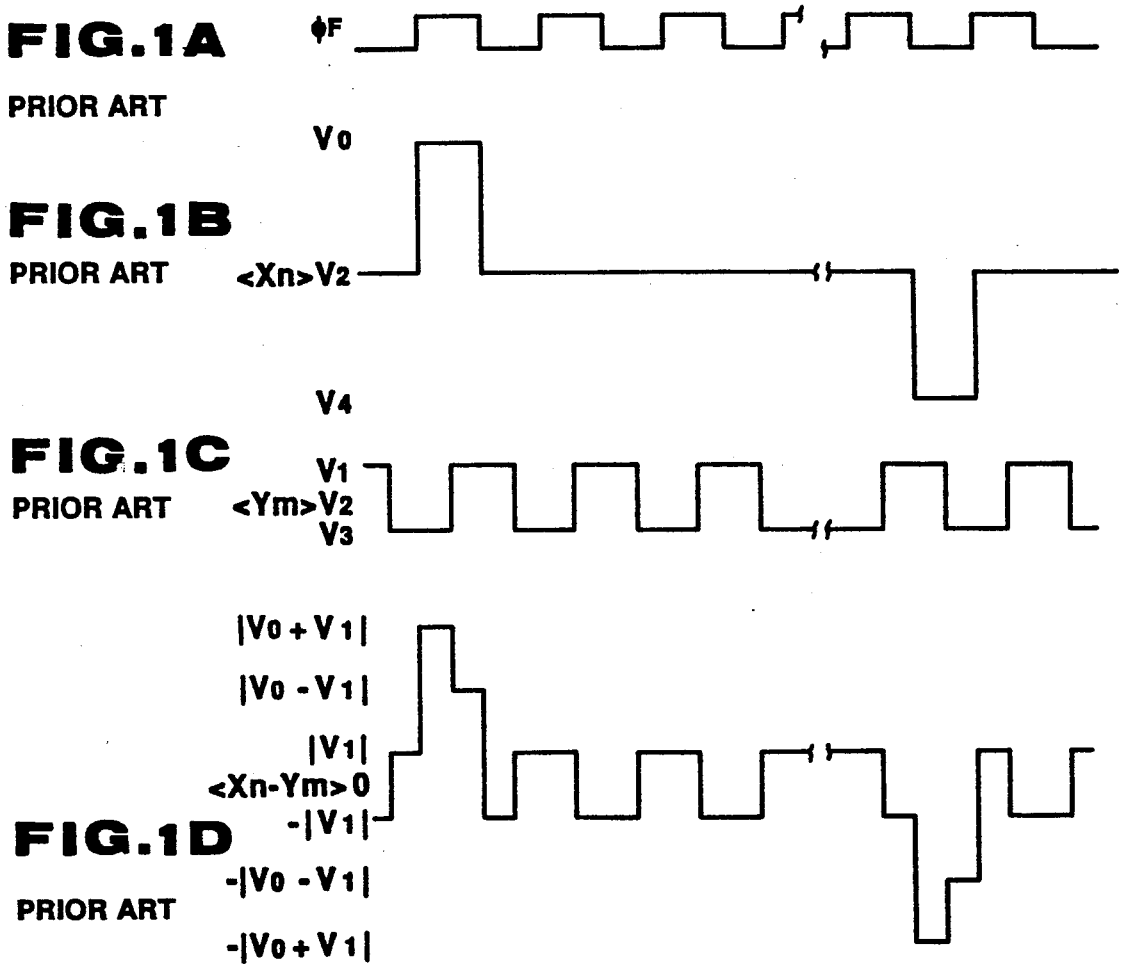
FIG.1A PRIOR ART
FIG.1B PRIOR ART
FIG.1C PRIOR ART
FIG.1D PRIOR ART
FIGS. 1A to 1D, each, are a timing chart illustrating waveforms of signals used in a conventional liquid-crystal display-panel driving system.
Figure 2:
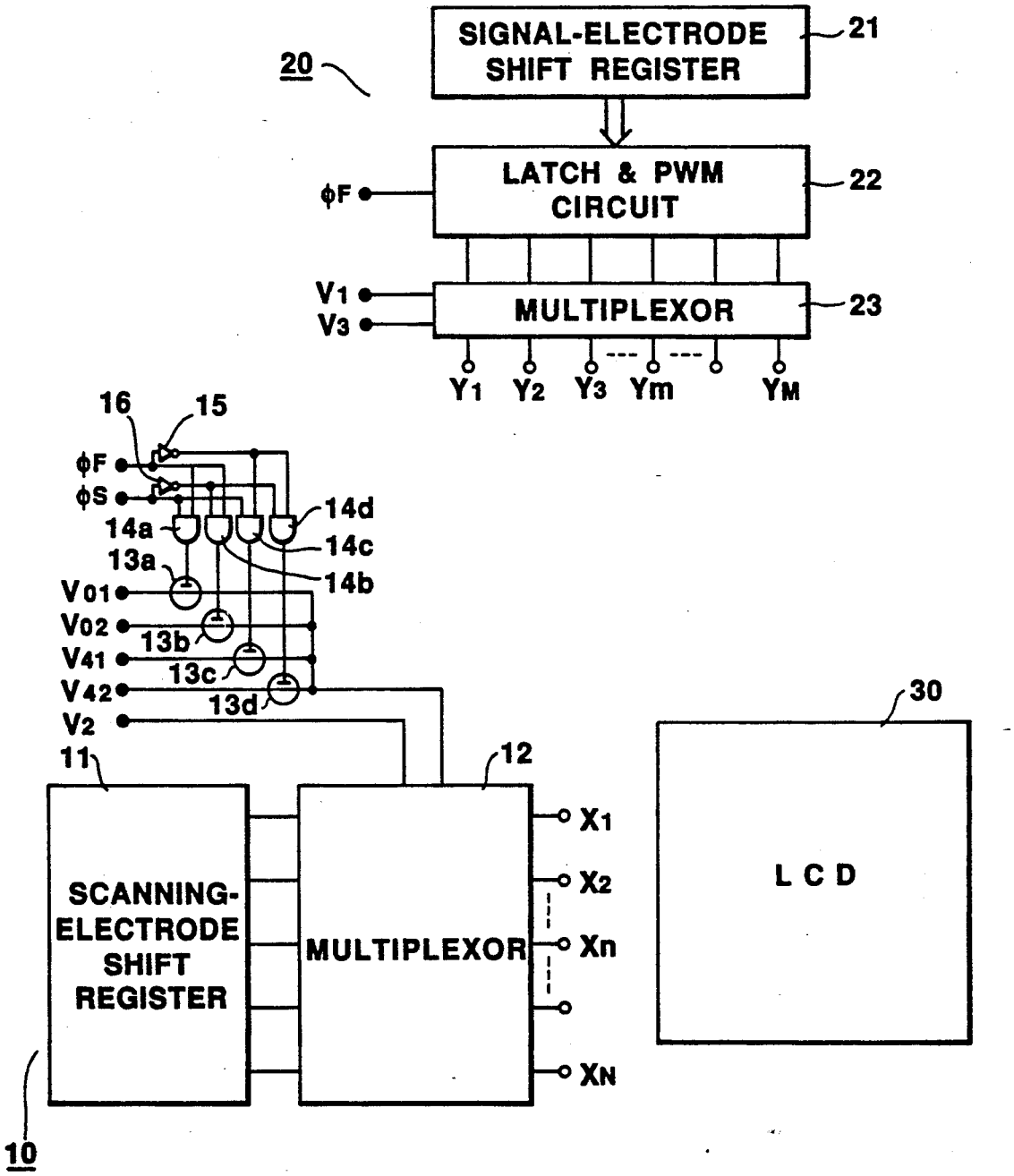

Embodiments of the present invention will be described with reference to the accompanying drawings. Referring to FIG. 2, reference numeral 10 denotes a scanning-electrode driving circuit, reference numeral 20 denotes a signal-electrode driving circuit and reference numeral 30 denotes a liquid-crystal display panel which has N units of scanning electrodes and M units of signal electrodes. The above scanning electrodes and signal electrodes are disposed in a matrix arrangement. The above scanning-electrode driving circuit 10 is composed of a scanning-electrode shift register 11 and a multiplexer 12. The scanning-electrode shift register 11 sequentially reads and shifts vertical timing signals delivered from a control section (not shown) in accordance with horizontal synchronizing signals and it outputs the vertical timing signals thus shifted to the multiplexer 12. Note that the above vertical timing signals are generated in synchronism with vertical synchronizing signals. Meanwhile, the multiplexer 12 is directly supplied with a bias voltage V2 and also supplied with bias voltages V01, V02, V41 and V42 through gate circuits 13*a* to 13*d*. The bias voltages V01, V02 (V41, V42) are set to values which are obtained by adding a fixed voltage "+V" or "−V" to a bias voltage V0 (V4) conventionally employed. The above gate circuits 13*a* through 13*d* are controlled by a frame signal $\phi$F and a timing signal s supplied through AND gates 14*a* through 14*d*. More specifically, the frame signal $\phi$F is directly supplied to AND gates 14*a*, 14*b* and supplied to AND gates 14*c*, 14*d* through an invertor 15. Meanwhile, the timing signal $\phi$s is directly supplied to and gates 14*a*, 14*c* and supplied to AND gates 14*b*, 14*d* through an invertor 16. The gate circuits 13*a* to 13*d* are ON/OFF controlled by output signals of the above AND gates 14*a* to 14*d* and thereby bias voltages V01, V02, V41 and V42 are selectively applied to the multiplexer 12. The number m of division of respective scanning-electrode selection period determines the frequency of the above timing signal $\phi$s. For example, in case that the number m of the division is "2", the frequency of the timing signal $\phi$s is set to be two times that of the frame signal $\phi$F. The above multiplexer 12 selects the above bias voltages in accordance with signals from the scanning electrode shift register 11 and supplies the selected bias voltages as scanning-electrode driving signals x1, x2, to xn to the liquid-crystal display panel 30.

In the meantime, the signal electrode driving circuit 20 is composed of a signal-electrode driving shift register 21, a latch and gradient signal generator circuit (PWM circuit) 22 and a multiplexer 23. The latch and gradient signal generator circuit 22 is supplied with the frame signal $\phi$F and the multiplexer 23 is supplied with bias voltages V1, V3. The above signal-electrode driving shift register 21 sequentially reads and shifts display data, e.g., video data of 4 bits which are successively transferred from a preceding circuit. After reading data for one line, the shift register 21 transfers the data to the latch and gradient signal generator circuit 22. The latch and gradient signal generator circuit 22 latches data transferred from the signal electrode driving shift register 21 and generates a gradient signal in accordance with the latched data. Further, the latch and gradient signal generator circuit 22 inverts the gradient signal every time when the signal level of the frame signal $\phi F$ is changed and outputs the gradient signal thus inverted to the multiplexer 23. In this case, the latch and gradient signal generator circuit 22 divides respective selection periods of the scanning electrodes by m (m is an integer equal to or greater than 2) and generates m gradient signals with respect to the same display data (video data) and the circuit 22 supplies the gradient signals to the multiplexer 23. In the present embodiment, "m" is set to "2", that is, "m=2". Hereinafter, the embodiment where "m=2" is selected will be described. The multiplexer 23 selects bias voltages V1, V3 according to the gradient signals delivered from the latch and gradient signal generator circuit 22 and outputs the selected bias voltages as signal-electrode driving signals Yl through YM to the liquid-crystal display panel 30.

Now, the operation of the above embodiment will be described with reference to timing charts of FIGS. 3A to 3E. In the scanning-electrode driving circuit 10, the gate circuits 13*a* through 13*d* are ON/OFF controlled in accordance with the frame signal $\phi F$ and the timing signal $\phi s$, and thereby bias voltages V01, V02, V41, V42 are selectively applied to the multiplexer 12. More particularly, in case that the frame signal $\phi F$ is high, AND gates 14*a* and 14*b* are selected. Therefore, when the timing signal $\phi s$ is high, the output of AND gate 14*a* becomes "1", causing the gate circuit 13*a* to open. Then the bias voltage V01 is selected by the gate circuit 13*a* and is applied to the multiplexer 13. When the timing signal $\phi s$ is low. The output of AND gate 14*b* becomes "1", causing the gate circuit 13*b* to open. Accordingly, the bias voltage V02 is selected by the gate circuit 13*b* and is applied to the multiplexer 13. In this case, the frequency of the timing signal $\phi s$ is set in accordance with the number of division of selection period during which each scanning electrode is operated. When the number of division of the selection period m is "2", the timing signal $\phi s$ has a frequency which is twice that of the frame signal $\phi F$ and its level is set high during the first half period of each frame and is set low during the latter half period of the frame. Therefore, when the frame signal $\phi$ is high, the bias voltage V01 is selected and applied to the multiplexer 12 during the first half period of the frame and the bias voltage V02 is selected and applied to the multiplexer 12 during the latter half period of the frame. In case that the frame signal $\phi F$ is low, AND gate 14*c* and 14*d* are selected. Therefore, the bias voltage V41 is selected and applied to the multiplexer 12 during the first half period of the frame in which the frame signal $\phi s$ is high, while the bias voltage V42 is selected and applied to the multiplexer 12 during the latter half period of the frame in which the timing signal $\phi s$ is low. The multiplexer 12 supplies the scanning electrodes selected by the scanning-electrode shift register 11 with the bias voltages supplied through the above gate circuits 13*a* to 13*d*. More specifically, when the frame signal $\phi F$ is high, the multiplexor 12 selects the bias voltage V01 during the first half period of the frame and the bias voltage V02 during the latter half period of the frame, and outputs these bias voltages V01, V02 as a scanning-electrode driving signal Xn to the liquid-crystal display panel 30. When the frame signal $\phi F$ is low, the multiplexer 12 selects the bias voltage V41 during the first half period of the frame and the bias voltage V42 during the latter half period, and outputs these voltages V41 and V42 as a scanning-electrode driving signal Xn to the liquid-crystal display panel 30. The multiplexer 12 also supplies bias voltage V2 to the scanning electrodes other than the scanning electrodes selected by the shift register 11.

Figures 3A, 3B, 3C, 3D, 3E:
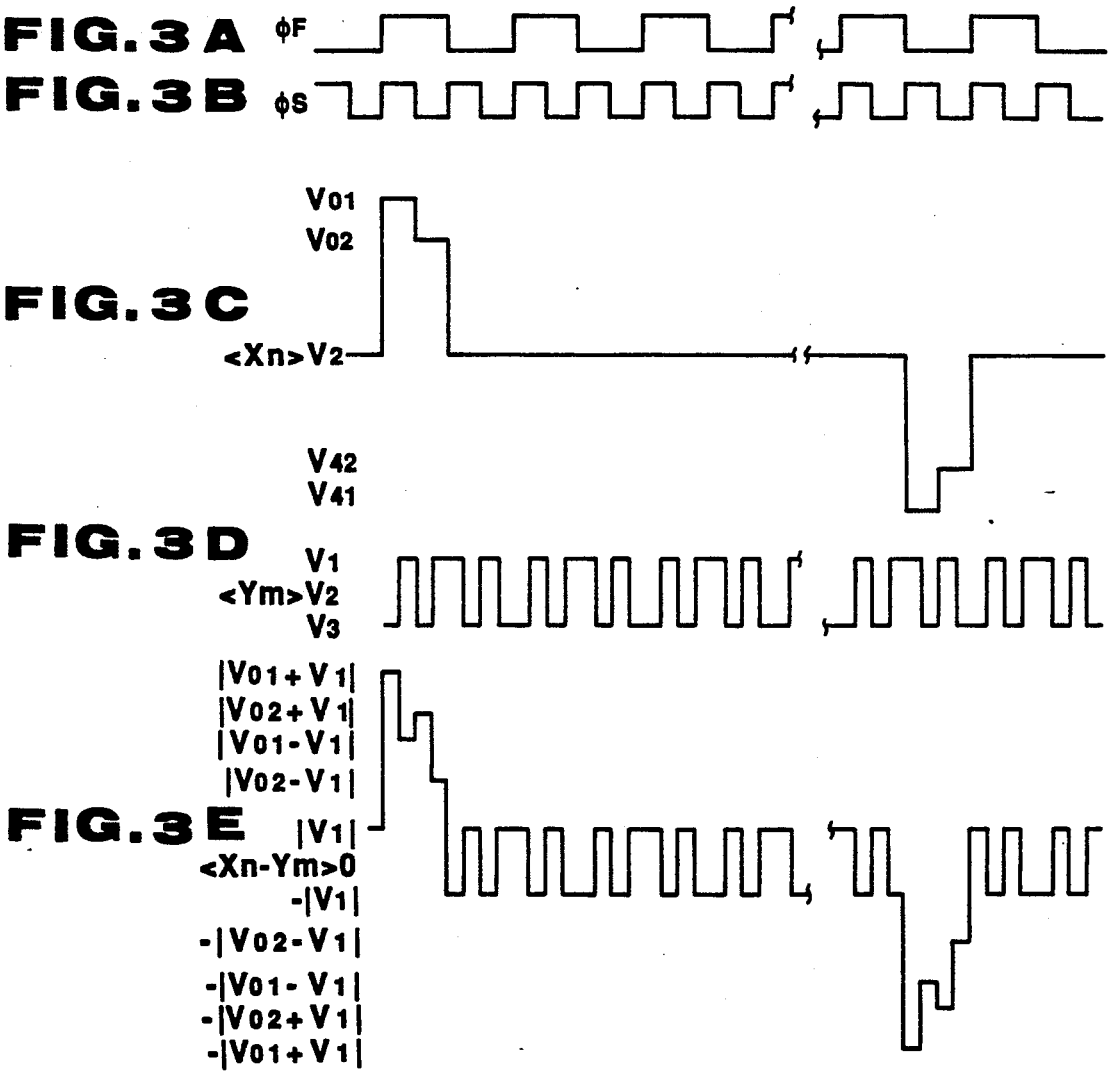
FIGS. 3A, 3B, 3C, 3D and 3E, each, are a timing chart representing the operation of the first embodiment.

Meanwhile, in the signal-electrode driving circuit 20, the latch and gradient-signal generator circuit 22 generates a gradient signal on the basis of the video signal delivered to the signal-electrode driving shift register 21. In this case, the latch and gradient-signal generator circuit 22 latches video data delivered from the signal-electrode driving shift register 21 and produces the same gradient signal corresponding to the data thus latched for m times, for example, two times during each selection period during which the scanning electrodes are operated and the shift register 21 supplies the gradient signal to the multiplexer 23. The multiplexer 23 selects the bias voltages V1 and V3 in accordance with the gradient signal from the latch and gradient signal generator circuit 22 as shown in FIG. 3 and provides these bias voltages V1 and V3 as the signal-electrode driving signal Ym to the liquid-crystal display panel 30. In FIGS. 3A to 3E, signal waveforms at a gradient rate of 50% to video data are shown.

The above liquid-crystal display panel 30 is driven by the composite signal "Xn-Ym", which are composed of the scanning-electrode driving signal Xn delivered from the scanning-electrode driving circuit 10 and the signal-electrode driving signal Ym delivered from the signal-electrode driving circuit 20.

The peak voltages of the above composite signal "Xn-Ym" will be given by "|V01+1 |" during the period of high level frame of the frame signal $\phi F$ and also by "−|V01+V1|" during the period of low level frame of the frame signal $\phi F$. In this case, the scanning-electrode driving signal Xn is set so as to be different in level in every division period. But, if liquid crystal material is the same, the effective liquid-crystal driving-voltage is equal to that, for conventional liquid crystal material, and the relationship between the bias voltages V01 and V0 is given by "V0<V01". Accordingly, as shown in FIG. 3E, the peak voltage |V01+V1| of the composite signal "Xn-Ym" during the selection period in which the scanning electrodes operate will be higher than a conventional value. In general, liquid crystals are driven by the effective voltage but in a microscopic sense, molecules in the liquid crystal are excited by the voltage instantaneously applied thereto. Therefore, a high peak voltage applied to liquid crystals increases the response speed.

Figure 4:
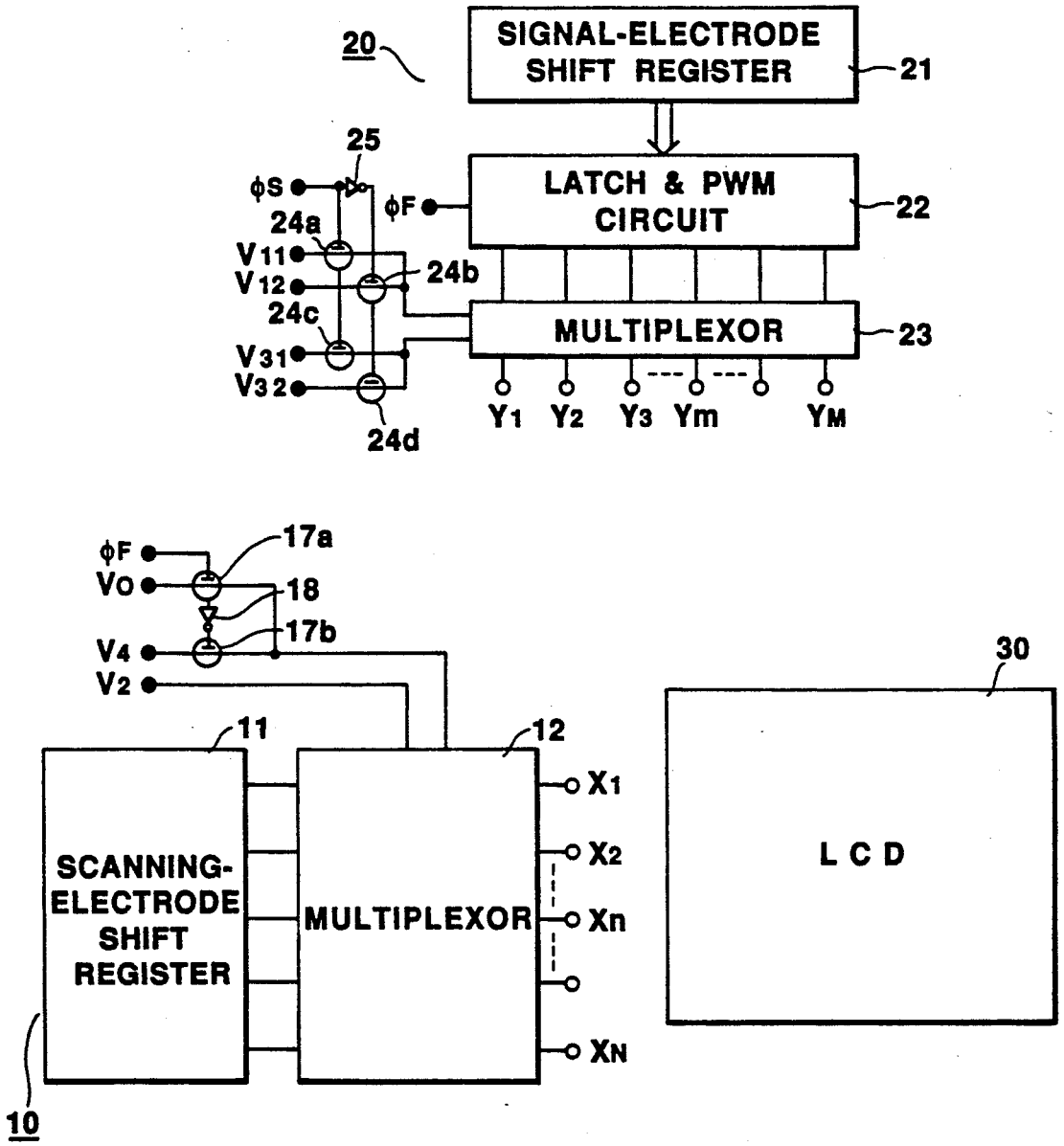

The second embodiment of the present invention will be described with reference to FIG. 4. In the above first embodiment, the peak level of the scanning-electrode driving signal is changed. On the contrary, the peak level of the signal electrode driving signal is changed in the second embodiment. More particularly, as shown in FIG. 4, the scanning-electrode driving circuit 10 is mainly composed of a scanning-electrode shift register 11 and a multiplexer 12. The multiplexer 12 is directly supplied with bias voltage V2 and is supplied with bias voltages V0 and V4 through gate circuits 17*a* and 17*b*, respectively. The gate circuit 17*a* is directly supplied with a frame signal $\phi F$ at its gate terminal and the gate circuit 17*b* is supplied with the frame signal $\phi F$ through an invertor 18. Accordingly, when the frame signal $\phi F$ is high, the bias voltage V0 is selected by the gate circuit 17*a* and then supplied to the multiplexer 12, and when the frame signal $\phi F$ is low, the bias voltage V4 is selected by the gate circuit 17*b* and supplied to the multiplexer 12. The multiplexer 12 selects the bias voltage V2 and the bias voltages V0 and V4 on the basis of an electrode selection signal delivered from the scanning-electrode shift register 11 and supplies the selected bias voltage as scanning-electrode driving signals Xl through XN to a liquid-crystal display panel 30. More particularly, the multiplexer 12 supplies the bias voltage V0 or V4 to the scanning electrodes selected by the scanning-electrode shift register 11 and supplies the bias voltage V2 to the electrodes other than the above selected electrodes.

Meanwhile, the signal-electrode driving circuit 20 is composed of a signal-electrode driving shift register 21, a latch and gradient signal generator circuit 22 and a multiplexer 23. The multiplexer 23 is supplied with bias voltages V11, V12, V31 and V32 through gate circuits 24*a* through 24*d*. The above bias voltage V11 is set to a value determined by adding a fixed voltage V to the bias voltage V1 and the bias voltage V12 is set to a value determined by subtracting the fixed voltage V from the bias voltage V1. In the same manner, the bias voltage V31 is set to a value determined by adding the fixed voltage V to the bias voltage V3 and the bias voltage V32 is set to a value determined by subtracting the fixed voltage V from the bias voltage V3. The above gate circuit 24*a*, 24*c* are directly supplied with a timing signal $\phi s$ and the gate circuit 24*b*, 24*d* are supplied with the timing signal $\phi s$ through an invertor 25. Accordingly, when the frame signal $\phi F$ is high, the bias voltages V11, V31 are supplied to the multiplexer 23 through gate circuits 24*a*, 24*c* and when the frame signal $\phi F$ is low, the bias voltages V12, V32 are supplied to the multiplexer 32 through the gate circuit 24*b*, 24*d*. The multiplexer 32 selects the above bias voltages on the basis of a gradient signal delivered from the latch and gradient signal generator circuit 22 and supplies the selected voltage as signal-electrode driving signals Yl to YM to the liquid-crystal display panel 30.

FIGS. 5A through 5E, each are a timing chart illustrating the operation of the second embodiment. In the scanning-electrode driving circuit 10 shown in FIG. 4, the gate circuits 17*a*, 17*b* are ON/OFF controlled in accordance with the frame signal $\phi F$ supplied thereto and thereby the bias voltages V0, V4 are selected and supplied to the multiplexer 12. More particularly, when the frame signal $\phi F$ is high, the gate circuit 17*a* becomes open and thereby the bias voltage V0 is supplied to the multiplexer 12. When the frame signal $\phi F$ is low, the gate circuit 17*b* becomes open and thereby the bias voltage V4 is supplied to the multiplexer 12. Accordingly, the multiplexor 12 supplies the bias voltage V0 or V4 to the scanning electrodes selected by the scanning-electrode shift register 11, as shown in FIG. 5C, and a supplies the bias voltage V2 as scanning-electrode driving signal Xl through XN to the electrodes other than the above selected electrodes.

Meanwhile, in the signal-electrode driving circuit 20, the bias voltages V11, V12, V31, V32 are selected by the gate circuits 24*a* to 25*d* in accordance with the timing signal $\phi s$ and are supplied to the liquid-crystal display panel 30. More particularly, when the timing signal $\phi s$ is high, the gate circuits 24*a* and 24*c* become open and thereby the bias voltages V11 and V31 are selected and supplied to the liquid-crystal display panel 30. When the timing signal $\phi s$ is low, the gate circuits 24*b* and 24*d* become open and thereby the bias voltages V12 and V32 are selected and supplied to the liquid-crystal display panel 30. Accordingly, a composite signal "Xn-Ym" having a waveform shown in FIG. 5E is applied between the scanning electrodes and the signal electrodes of the liquid-crystal display panel 30. The peak voltage of the composite signal "Xn-Ym" will be "|V0+V11|". As a result, the peak voltage "|V0+V11|" of the composite signal "Xn-Ym" during the selection period in which the scanning electrodes are selected to operate become higher than usual in the similar manner to that in the first embodiment, and thereby the response speed of the liquid crystal is improved.

Figure 6:
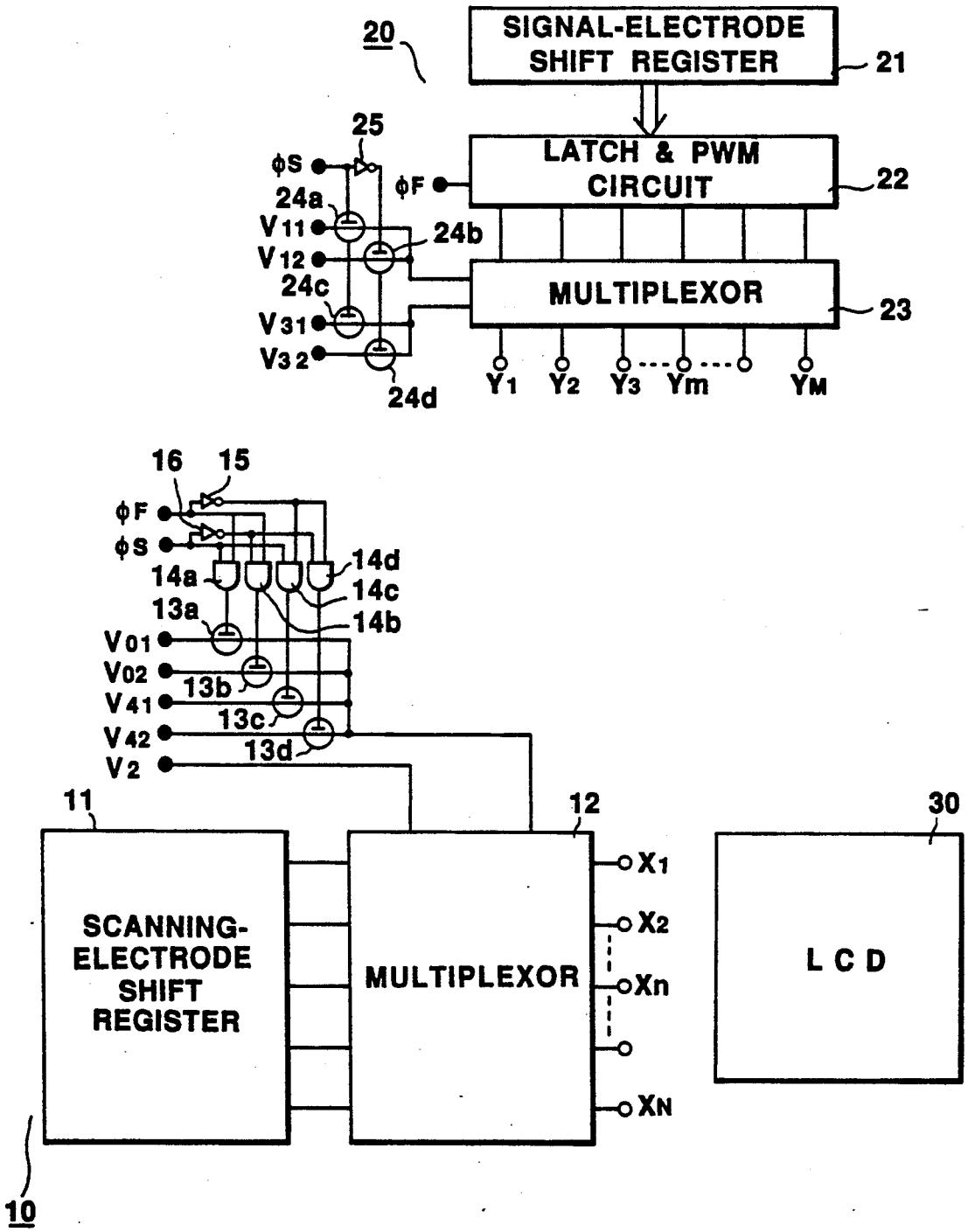
Figures 7A, 7B, 7C, 7D, 7E:
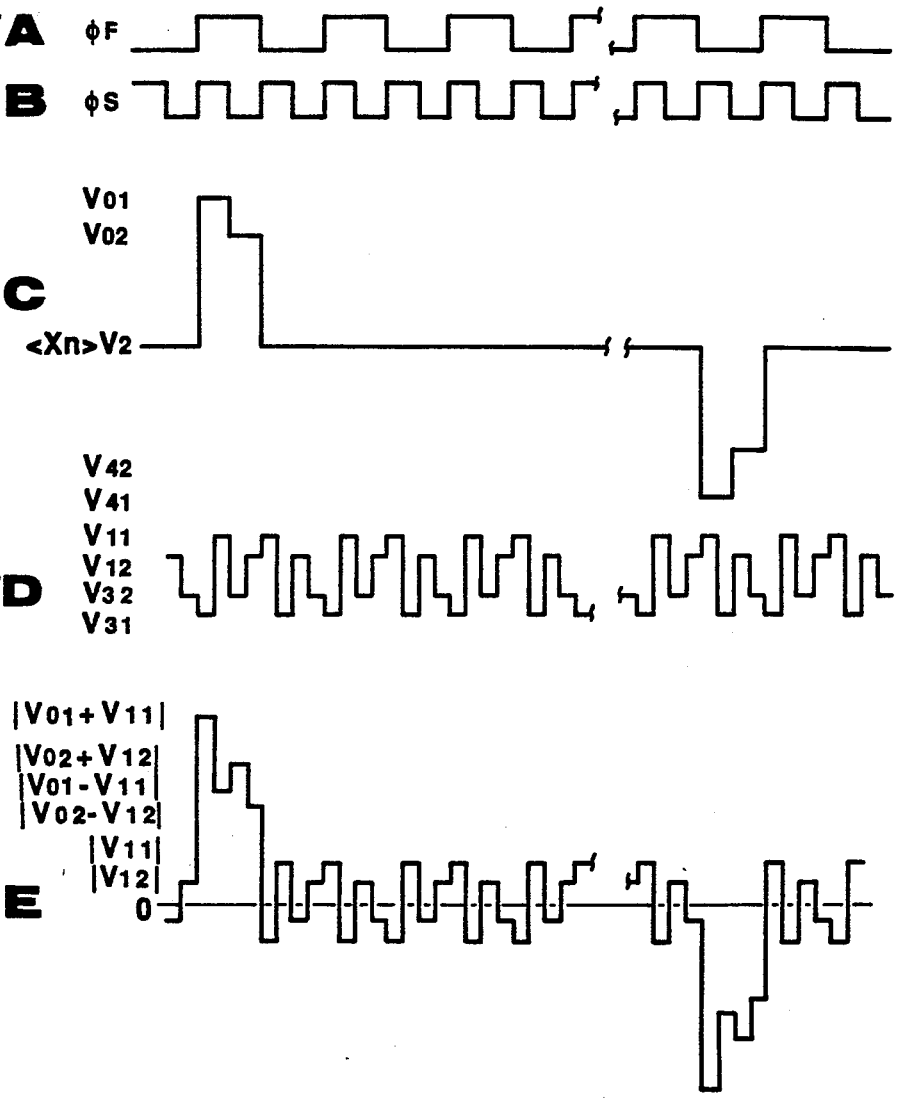
FIGS. 7A, 7B, 7C, 7D and 7E, each, are a timing chart illustrating the operation of the third embodiment.

FIG. 6 is a view illustrating the third embodiment of the present invention. The third embodiment is a combination of the first and second embodiments, and has the same scanning-electrode driving circuit 10 as that in the first embodiment and the same signal-electrode driving circuit 20 as that in the second embodiment. Accordingly, as shown in timing charts of FIGS. 7A to 7E, the signal waveforms of the scanning-electrode driving signal and the signal-electrode driving signal change in synchronism with the timing signal $\phi s$, respectively. The composite waveform "Xn-Ym" of the scanning-electrode driving signal and the signal-electrode driving signal will have the peak voltage "|V01+V11|" during the selection period in which the scanning electrodes are selected to operate. Hence the above peak voltage "|V01+V11|" is higher than those in the first and second embodiments, and thereby the response characteristic of the liquid crystal can be highly improved.

Now, the third embodiment will be compared with a conventional example in terms of a margin of voltage for driving the liquid-crystal display.

Figure 8:
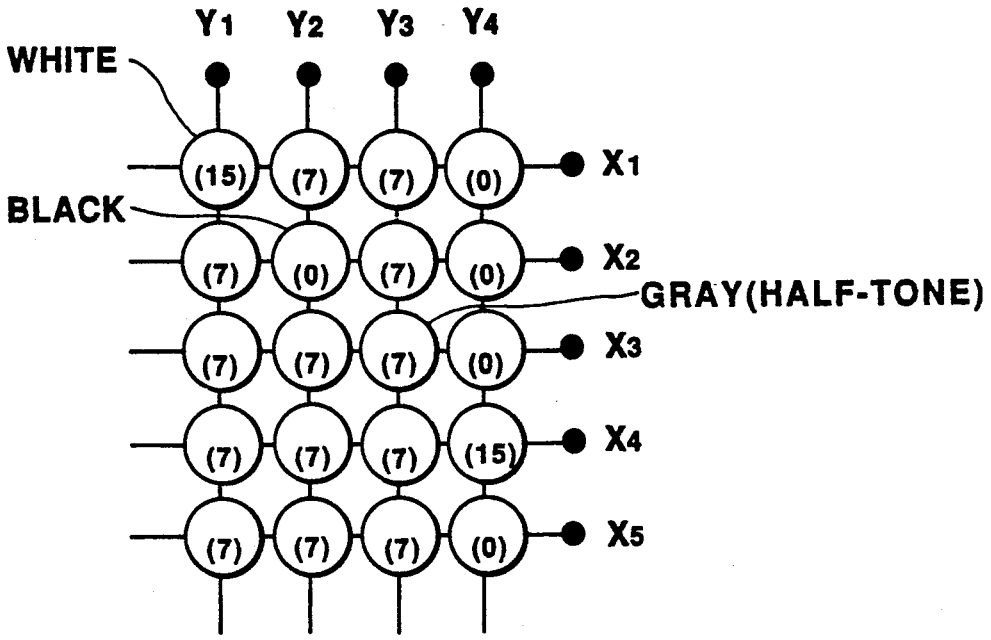
FIG. 8 is a view illustrating concept of a matrix display-panel, which is effective to compare the third embodiment to a conventional example.

FIG. 8 is a view illustrating a 5×4 matrix panel. FIGS. 9A to 9H and 12A to 10F, each are a view illustrating an example of a driving waveform, corresponding to that in the third embodiment, to display a pattern shown in FIG. 8. Examples of driving waveforms of the scanning electrodes and the signal electrodes when a common selection period is divided by two, are shown in FIGS. 9A to 9H. Gradient is given by 4 bits and therefore is represented in 16 levels. When the gradient is "0", the liquid crystal is turned off, and when the gradient is "15", the liquid crystal is turned on. As illustrated in FIGS. 9A to 9H, gradient signals given by display data are displayed in the first and latter half periods of the divided selection period, respectively. In each half period, bias voltage/scanning voltage or V11/V01, V12/V02 is changed FIGS. 10*a* to 10*F* each are a view illustrating a driving waveform when the selection period is divided by three (m=3) in the third embodiment.

Hereinafter, effective voltages $V_{ON}$, $V_{OFF}$ and the margin $\alpha$ defined by $V_{ON}/V_{OFF}$ will be described with reference to the third embodiment.

Conventional Example

It is assumed that $VO=(a-1)V1$ $V3=-V1$ $V4=-V0$

Then, voltage $V_{ON}$, $V_{OFF}$ applied to selected picture elements and non-selected picture elements are given by $$V_{ON} = \sqrt{\frac{1}{N} a^2 V1^2 + \frac{N-1}{N} V1^2} \quad (1)$$

$$V_{OFF} = \sqrt{\frac{1}{N} (a-2)^2 V1^2 + \frac{N-1}{N} V1^2} \quad (2)$$

Hence, the driving margin $\alpha$ is given by $$\alpha = V_{ON}/V_{OFF} = \sqrt{\frac{a^2 + N - 1}{(a-2)^2 + N - 1}} \quad (3)$$

The maximum margin $\alpha_{max}$ at $a=\sqrt{N}+1$ is calculated from $$\alpha_{max} = \sqrt{\frac{\sqrt{N}+1}{\sqrt{N}-1}} \quad (4)$$

3rd Embodiment

It is assumed that $$V01 = (a-1)V11, \quad V02 = (b-1)V12$$
$$V31 = -V11, \quad V32 = -V12$$
$$V41 = -V01, \quad V42 = -V02$$

Then, the voltages $V_{ON}$, $V_{OFF}$ are given by $$V_{ON} = \sqrt{\frac{1}{2N} a^2 V11^2 + \frac{1}{2N} b^2 V12^2 + \frac{N-1}{2N} V11^2 + \frac{N-1}{2N} V12^2} \quad (5)$$

$$V_{OFF} = \sqrt{\frac{1}{2N} (a-2)^2 V11^2 + \frac{1}{2N} (b-2)^2 V12^2 + \frac{N-1}{2N} V11^2 + \frac{N-1}{2N} V12^2} \quad (6)$$

Hence, the driving margin $\alpha$ is given by $$\alpha = \frac{V_{ON}}{V_{OFF}} = \sqrt{\frac{a^2 V11^2 + b^2 V12^2 + (N-1)V11^2 + (N-1)V12^2}{(a-2)^2 V11^2 + (b-2)^2 V12^2 + (N-1)V11^2 + (N-1)V12^2}} \quad (7)$$

If a=b, $V_{ON}$, $V_{OFF}$ and $\alpha$ would be $$V_{ON} = \sqrt{\frac{1}{2N} a^2 (V11^2 + V12^2) + \frac{N-1}{2N} (V11^2 + V12^2)} \quad (8)$$

$$V_{OFF} = \sqrt{\frac{1}{2N} (a-2)^2 (V11^2 + V12^2) + \frac{N-1}{2N} (V11^2 + V12^2)} \quad (9)$$

-continued $$\alpha = \sqrt{\frac{\{a^2 + N - 1\} \cdot (V11^2 + V12^2)}{\{(a-2)^2 + N - 1\} \cdot (V11^2 + V12^2)}} = \sqrt{\frac{a^2 + N - 1}{(a-2)^2 + N - 1}} \quad (10)$$

As seen from Eq.(10), the driving margin $\alpha$ is given by Eq.(3), independently of voltages V11 and V12.

If same liquid crystal is used in the conventional example and the third embodiment, Eqs. (2) and (9) would have an equal value since Vth of both liquid crystals are equal to each other. Hence, if voltages V11 and V12 are selected so as to satisfy the following Equation (11).

$$\sqrt{\frac{1}{N} (a-2)^2 V1^2 + \frac{N-1}{N} V1^2} = \sqrt{\frac{1}{2N} (a-2)^2 (V11^2 + V12^2) + \frac{N-1}{2N} (V11^2 + V12^2)} \quad (11)$$

$$(a-2)^2 V1^2 + (N-1)V1^2 = (a-2)^2 (V11^2 + V12^2)/2 + (N-1)(V11^2 + V12^2)/2$$

$$V1^2\{(a-2)^2 + (N-1)\} = (a-2)^2 (V11^2 + V12^2)/2 + (N-1)(V11^2 + V12^2)/2 = (V11^2 + V12^2)\{(a-2)^2 + (N-1)\}/2$$

$$V1^2 = (V11^2 + V12^2)/2$$

$$2V1^2 = V11^2 + V12^2$$

the effective voltages $V_{ON}$, $V_{OFF}$, and the margins $\alpha$ in the conventional example and the third embodiment would be equal to each other.

What is claimed is:

1. A liquid-crystal display apparatus having liquid crystals operable with a predetermined driving voltage applied during respective display periods, comprising:

liquid-crystal display panel means including scanning electrodes and signal electrodes, both of which are disposed in a matrix arrangement;

display control means for dividing a selection period during which said scanning electrodes are to be drive into m divided periods wherein m is a positive integer, and for repeatedly displaying a picture based on common video data for m times; and scanning-electrode driving means for driving said scanning electrodes with a plurality of voltage values each corresponding to each of m divided periods divided by said display control means so that a different voltage difference is applied between said scanning electrodes and said signal electrodes in each respective divided period, and an effective driving voltage applied to said scanning electrodes during the display period is equivalent to said predetermined driving voltage.

2. A liquid-crystal display apparatus according to claim 1, wherein said display control means divides the selection period during which the scanning electrodes are to be driven into m continuous periods wherein m is a positive integer, and repeatedly displays a picture based on common video data for m times.

3. A liquid-crystal display apparatus having liquid crystals operable with a predetermined driving voltage applied during respective display periods, comprising:

liquid-crystal display panel means including scanning electrodes and signal electrodes, both of which are disposed in a matrix arrangement;

display control means for dividing respective display periods during which said signal electrodes are to be driven into m divided periods wherein m is a positive integer, and for repeatedly displaying a picture based on common video data for m times; and signal-electrode driving means for driving said signal electrodes with a plurality of voltage values each corresponding to each of m divided periods divided by said display control means so that a different voltage difference is applied between said scanning electrodes and said signal electrodes in each respective one of said divided periods, and an effective driving voltage applied to said signal electrodes during the display period is equivalent to said predetermined driving voltage.

4. A liquid-crystal display apparatus according to claim 3, wherein said display control means divides the selection period during which the scanning electrodes are to be driven into m continuous periods wherein m is a positive integer, and repeatedly displays a picture based on common video data for m times.

5. A liquid-crystal display apparatus having liquid crystals operable with a predetermined driving voltage applied during respective display periods, comprising:

liquid-crystal display panel means including scanning electrodes and signal electrodes, both of which are disposed in a matrix arrangement;

display control means for dividing a selection period during which said scanning electrodes are to be driven into m divided periods wherein m is a positive integer, and for repeatedly displaying a picture based on common video data for m times; and electrode driving means for driving said signal electrodes and said scanning electrodes with voltages each having a value corresponding to one of the divided periods divided by said display control means so that a different voltage difference is applied between said scanning electrodes and said signal electrodes in the respective divided periods, and an effective driving voltage applied to said scanning electrodes during the display period is equivalent to said predetermined driving voltage.

6. A liquid-crystal display apparatus according to claim 5, wherein said display control means divides the selection period during which said scanning electrodes are to be driven into m continuous period wherein m is a positive integer, and repeatedly displays a picture based on common video data for m times.

7. A liquid-crystal display apparatus having liquid crystals operable with a predetermined driving voltage applied during respective display periods, comprising:

liquid-crystal display panel means including scanning electrodes and signal electrodes both of which are disposed in a matrix arrangement;

display control means for dividing respective selection periods during which said scanning electrodes are to be driven into m divided periods wherein m is a positive integer, and for repeatedly displaying a picture based on common video data for m times; and driving-voltage control means for selecting driving voltage from among at least five driving voltages each having a different voltage value such that different voltage values each corresponding to a respective divided period are applied to said scanning electrodes, and an effective driving voltage applied to said signal electrodes during the display period is equivalent to said predetermined driving voltage.

8. A liquid-crystal display apparatus according to claim 7, wherein said display control means divides the selection period during which said scanning electrodes are to be driven into m continuous periods wherein m is a positive integer, and repeatedly displays a picture based on common video data for m times.

9. A liquid-crystal display apparatus having liquid crystals operable with a predetermined driving voltage applied during respective display periods, comprising:

liquid-crystal display panel means including scanning electrodes and signal electrodes both of which are disposed in a matrix arrangement;

display control means for dividing respective selection periods during which said scanning electrodes are to be driven into m divided periods wherein m is a positive integer, and for repeatedly displaying a picture based on common video data for m times; and driving-voltage control means for selecting a driving voltage from among at least four driving voltages each having a different voltage value such that different voltage values each corresponding to the respective divided periods are applied to said signal electrodes, and an effective driving voltage applied to said signal electrodes during the display period is equivalent to said predetermined driving voltage.

10. A liquid-crystal display apparatus according to claim 9, wherein said display control means divides the selection period during which said scanning electrodes are to be driven into m continuous periods wherein m is a positive integer, and repeatedly displays a picture based on common video data for m times.

11. A liquid-crystal display apparatus having liquid crystals operable with a predetermined driving voltage applied during respective display periods, comprising:

liquid-crystal display panel means including scanning electrodes and signal electrodes both of which are disposed in a matrix arrangement;

display control means for dividing respective selection periods during which said scanning electrodes are to be driven into m divided periods wherein m is a positive integer, and for repeatedly displaying a picture based on common video data for m times; and driving-voltage control means for selecting a driving voltage from among at least four driving voltages such that different voltage values each corresponding to the respective divided periods are applied to said scanning electrodes and said signal electrodes, and an effective driving voltage applied to said signal electrodes during the display period is equivalent to said predetermined driving voltage.

12. A liquid-crystal display apparatus according to claim 11, wherein said display control means divides the selection period during which said scanning electrodes are to be driven into m continuous periods wherein m is a positive integer, and displays repeatedly a picture based on common video data for m times.

13. A liquid-crystal display apparatus, comprising:

liquid-crystal display panel means including scanning electrodes and signal electrodes, both of which are disposed in a matrix arrangement;

display control means for dividing a selection period during which said scanning electrodes are to be driven into m continuous periods wherein m is a positive integer, and for displaying repeatedly a picture based on common video data for m times; and electrode driving means for driving said scanning and said signal electrodes with a plurality of driving-waveform levels each corresponding to each of m continuous periods.

14. A system for driving a liquid-crystal display-panel device having scanning electrodes and signal electrodes to which scanning signals and display signals are supplied, respectively, the system comprising:

selecting means for selecting one of said scanning electrodes successively;

scanning-signal supplying means for applying a first potential to the scanning electrode and thereafter applying at least a second potential thereto such that a potential difference applied between said selected scanning electrode and said signal electrodes substantially changes while said scanning electrode is selected by said selecting means; and display-signal supplying means for supplying a same display signal to said signal electrodes twice when the first potential is applied to the scanning electrode selected by said selecting means, and when the second potential is applied to the selected scanning electrode.

15. The system according to claim 14, wherein said display signal is pulse-width modulated and said signal electrodes are supplied with the same pulse-width modulated display signal twice at a time when the first potential is applied to said scanning electrode and at a time when the second potential is applied to said scanning electrode.

16. The system according to claim 14, wherein said scanning-signal supplying means applies the second potential to the scanning electrode after applying the first potential thereto such that a potential difference applied between said scanning electrode and said signal electrodes decreases while said scanning electrode is selected by said selecting means.

17. The system according to claim 14, wherein said scanning signal is inverted at a predetermined interval while said display signal is inverted in synchronism with said scanning signal.

18. A system for driving a liquid-crystal display-panel device having scanning electrodes and signal electrodes to which scanning signals and display signals are supplied, respectively, the system comprising:

selecting means for selecting one of said scanning electrodes successively; and display-signal supplying means for supplying, separately and several times, but with an equivalent effective voltage in total, said signal electrodes with display signals corresponding to the scanning electrode while said scanning electrode is selected by said selecting means, and for increasing the response rate of liquid crystals of the liquid-crystal display panel device.

19. The system according to claim 18, wherein said display-signal supplying means applies the display signal to the signal electrodes at least twice so that at first a potential difference of a high level is applied between the scanning electrode and said signal electrodes and then a potential difference of a low level is applied therebetween while said scanning electrode is selected by said selecting means.

20. The system according to claim 19, wherein said display signal supplied from said display-signal supplying means is pulse-width modulated and the pulse-width modulated signal is separately supplied at least twice to said signal electrodes, and wherein a potential difference between a mean value of the pulse-width modulated signal and the scanning signal applied to the selected scanning electrode is large at first and then the potential difference is small.

21. The system according to claim 18, wherein said scanning signal is inverted at a predetermined interval while said display signal is inverted in synchronism with said scanning signal.

22. A system for driving a liquid-crystal display-panel device having scanning electrodes and signal electrodes to which scanning signals and display signals are supplied, respectively, the system comprising:

selecting means for selecting one of said scanning electrodes successively;

scanning-signal supplying means for applying at least a second potential to the scanning electrode selected by said selecting means after applying a first potential thereto; and display-signal supplying means for supplying a display signal of a different level at least twice, but with an equivalent effective voltage in total, to said signal electrodes while a scanning electrode is selected by said selecting means, said display signal corresponding to the selected scanning electrode.

23. The system according to claim 22, wherein said display signal supplied from said display-signal supplying means is pulse-width modulated and the pulse-width modulated signal is separately supplied at least twice to said signal electrodes, and wherein a potential difference between a mean value of the pulse-width modulated signal and the scanning signal applied to the selected scanning electrode is large at first and then the potential difference is small.

24. The system according to claim 22, wherein said scanning signal is inverted at a predetermined interval while said display signal is inverted in synchronism with said scanning signal.

25. In a liquid-crystal display-panel device having scanning electrodes and signal electrodes a scanning electrode being successively selected from said scanning electrodes by a selecting means, a scanning signal being supplied to the selected scanning electrode, a display signal corresponding to the selected scanning electrode being supplied to the signal electrodes, and wherein liquid crystals are driven by an effective value of voltage applied between the selected scanning electrode and the signal electrodes, a system for driving the liquid crystals comprising:

means for applying between the scanning electrode selected by the selecting means and said signal electrodes a voltage higher than a given voltage level based on the display signal at first and then applying therebetween a voltage lower than the given voltage level, so that a voltage whose effective value is substantially equivalent to the given voltage is applied between the selected scanning electrode and said signal electrodes.

26. The system for driving the liquid-crystals according to claim 25, wherein said display signal is pulse-width modulated.

27. The system for driving the liquid-crystals according to claim 25, wherein said scanning signal is inverted at a predetermined interval while said display signal is inverted in synchronism with said scanning signal.

28. In a liquid-crystal display-panel device having scanning electrodes and signal electrodes, a scanning electrode being successively selected from said scanning electrodes by a selecting means, a scanning signal being supplied to the selected scanning electrode, a display signal corresponding to the selected scanning electrode being supplied to the signal electrodes, and wherein liquid crystals are driven by an effective value of voltage applied between the selected scanning electrode and the signal electrodes, a method of driving the liquid crystals comprising the steps of:

a. dividing a period during which a scanning electrode is selected by said selecting means, into a plurality of period; and b. applying between said scanning electrode selected by said selecting means and said signal electrodes a voltage difference which is different in each of the plurality of periods and an effective value of which is substantially equivalent to an effective value of a given voltage difference based on the display signal.

29. In a liquid-crystal display-panel device having scanning electrodes and signal electrodes, a scanning electrode being successively selected from said scanning electrodes by a selecting means, a scanning signal being supplied to the selected scanning electrode, a display signal corresponding to the selected scanning electrode being supplied to the signal electrodes, and wherein liquid crystals are driven by an effective value of voltage applied between the selected scanning electrode and the signal electrodes, a method of driving the liquid crystals comprising the steps of:

a. dividing a period, during which a scanning electrode is selected by said selecting means, into a plurality of periods; and b. applying the scanning signal to said scanning electrodes and applying the display signal to said signal electrodes, so that a voltage difference which is different in each of the plurality of periods, and an effective value of which is substantially equivalent to an effective value of a given voltage is applied between the scanning electrode selected by said selecting means and said signal electrode.

30. A liquid-crystal display apparatus, comprising:

liquid-crystal display panel means including scanning electrodes and signal electrodes, both of which are disposed in a matrix arrangement;

display control means for dividing a selection period during which said scanning electrodes are to be driven into m divided periods wherein m is a positive integer, and for repeatedly displaying a picture based on common video data for m times; and scanning-electrode driving means for driving said scanning electrodes with a plurality of voltage values each corresponding to each of m divided periods divided by said display control means so that a different voltage difference of the same polarity is applied between said scanning electrodes and said signal electrodes in each respective divided period.

31. A liquid-crystal display apparatus, comprising:

liquid crystal display means including scanning electrodes and signal electrodes, both of which are disposed in a matrix arrangement;

display control means for dividing respective display periods during which said signal electrodes are to be driven into m divided periods wherein m is a positive integer, and for repeatedly displaying a picture based on common video data for m times; and signal-electrodes driving means for driving said signal electrodes with a plurality of voltage values each corresponding to each of m divided periods by said display control means so that a different voltage difference of the same polarity is applied between said scanning electrodes and said signal electrodes in each respective one of said divided periods.

32. A liquid-crystal display apparatus, comprising:

liquid-crystal display panel means including scanning electrodes and signal electrodes, both of which are disposed in a matrix arrangement;

display control means for divided a selection period during which said scanning electrodes are to be driven into a divided periods wherein m is a positive integer, and for repeatedly displaying a picture based on common video data for m times; and electrodes driving means for driving said signal electrodes and said scanning electrodes with voltages each having a value corresponding to one of the divided periods divided by said display control means so that a different voltage difference of the same polarity is applied between said scanning electrodes and said signal electrodes in the respective divided periods.

33. A liquid-crystal display apparatus having liquid crystals applicable with a predetermined driving voltage applied during a frame period involving a predetermined number of display periods, comprising:

liquid-crystal display panel means including scanning electrodes and signal electrodes, both of which are diagnosed in a matrix arrangement;

signal electrode driving means for dividing said respective display periods during which said signal electrodes are to be driven into two divided periods, and driving said signal electrodes twice during each of the display periods, wherein a voltage of V11 is applied to said signal electrodes during the first divided period and a voltage of V12 is applied to said signal electrodes during the second divided period, and these voltages are defined by the following equation:

$$2V1^2 = V11^2 + V12^2$$

where V1 stands for said predetermined driving voltage, and wherein an effective voltage applied to said signal electrodes during the frame period is equivalent to the effective value of said predetermined driving voltage.

34. A liquid-crystal display apparatus according to claim 33, wherein the voltages V11 and V12 are different from each other.

35. A liquid-crystal display apparatus according to claim 34, wherein the voltage V11 is higher than the voltage V12.

* * * * *